US007390601B2

(12) United States Patent
Wu et al.

(10) Patent No.: US 7,390,601 B2
(45) Date of Patent: Jun. 24, 2008

(54) IMAGING MEMBER COMPRISING MODIFIED BINDER

(75) Inventors: Jin Wu, Webster, NY (US); Yuhua Tong, Webster, NY (US); Linda L. Ferrarese, Rochester, NY (US); John J. Wilbert, Macedon, NY (US); Edward C. Savage, Webster, NY (US); Liang-Bih Lin, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 386 days.

(21) Appl. No.: 11/154,887

(22) Filed: Jun. 16, 2005

(65) Prior Publication Data

US 2006/0286470 A1 Dec. 21, 2006

(51) Int. Cl.
*G03G 5/047* (2006.01)

(52) U.S. Cl. ..... 430/58.8; 430/59.1; 430/123.43

(58) Field of Classification Search ..... 430/58.8, 430/59.1, 123.43
See application file for complete search history.

(56) References Cited

U.S. PATENT DOCUMENTS

| | | | |
|---|---|---|---|
| 2,610,120 | A | 9/1952 | Minsk et al. |
| 2,670,284 | A | 2/1954 | Zvanut |
| 2,670,286 | A | 2/1954 | Minsk et al. |
| 3,180,730 | A | 4/1965 | Klupfel et al. |
| 3,240,597 | A | 3/1966 | Fox |
| 3,250,615 | A | 5/1966 | Van Allan et al. |
| 3,274,000 | A | 9/1966 | Noe et al. |
| 3,542,547 | A | 11/1970 | Wilson |
| 3,567,450 | A | 3/1971 | Brantly et al. |
| 3,625,402 | A | 12/1971 | Kulis |
| 3,658,520 | A | 4/1972 | Brantly et al. |
| 3,732,301 | A | 5/1973 | Sletzinger et al. |
| 4,127,412 | A | 11/1978 | Rule et al. |
| 4,298,677 | A | 11/1981 | Takagi et al. |
| 4,338,390 | A | 7/1982 | Lu |
| 4,423,129 | A | 12/1983 | Takasu et al. |
| 4,446,217 | A | 5/1984 | Takasu et al. |
| 4,456,671 | A | 6/1984 | Mabuchi et al. |
| 4,464,450 | A | 8/1984 | Teuscher |
| 4,481,271 | A | 11/1984 | Hashimoto et al. |
| 4,487,824 | A | 12/1984 | Katagiri et al. |
| 4,554,231 | A | 11/1985 | Ishikawa et al. |
| 4,560,635 | A | 12/1985 | Hoffend et al. |
| 4,666,802 | A | 5/1987 | Hung et al. |
| 4,701,396 | A | 10/1987 | Hung et al. |
| 4,727,139 | A | 2/1988 | Hung et al. |
| 4,921,773 | A | 5/1990 | Melnyk et al. |
| 6,586,148 | B1 * | 7/2003 | Graham et al. ..... 430/58.65 |

FOREIGN PATENT DOCUMENTS

| | | | |
|---|---|---|---|
| JP | 54142296 | A * | 11/1979 |
| SU | 1613995 | A * | 12/1990 |

OTHER PUBLICATIONS

English translation of SU 1613995 (Dec. 15, 1990).*

* cited by examiner

*Primary Examiner*—Christopher RoDee
(74) *Attorney, Agent, or Firm*—Eugene O. Palazzo; Fay Sharpe LLP

(57) ABSTRACT

A photoconductive imaging member is provided comprising a substrate, an optional hole blocking layer, a charge generation layer, and a charge transport layer. The charge generation layer includes a charge generating material and a binder, wherein the binder comprises an electron transport material chemically attached to a polymeric binder material.

17 Claims, 3 Drawing Sheets

IMAGING MEMBER COMPRISING MODIFIED BINDER

BACKGROUND

The present disclosure relates, in various exemplary embodiments, to photoconductive imaging members. In particular, the present disclosure relates to charge generation layers for photoconductive imaging members wherein the charge generation layers comprise a novel binder composition. More specifically, disclosed herein is a charge generation layer for a photoconductive imaging member comprising a photogenerating pigment and a binder, the binder comprising a modified binder material comprising an electron transport material chemically attached to a polymeric binder material.

In the art of electrophotography, an electrophotographic imaging member or plate comprising a photoconductive insulating layer on a conductive layer is imaged by first uniformly electrostatically charging the surface of the photoconductive insulating layer. The plate is then exposed to a pattern of activating electromagnetic radiation, for example light, which selectively dissipates the charge in the illuminated areas of the photoconductive insulating layer while leaving behind an electrostatic latent image in the non-illuminated areas. This electrostatic latent image may then be developed to form a visible image by depositing finely divided electroscopic toner particles, for example from a developer composition, on the surface of the photoconductive insulating layer. The resulting visible toner image can be transferred to a suitable receiving member such as paper. This imaging process may be repeated many times with reusable photosensitive members.

Electrophotographic imaging members are usually multilayered photoreceptors that comprise a substrate support, an electrically conductive layer, an optional hole blocking layer, an optional adhesive layer, a charge generating layer, a charge transport layer, and optional protective or overcoating layer(s). The imaging members can take several forms, including flexible belts, rigid drums, etc. For most multilayered flexible photoreceptor belts, an anti-curl layer is usually employed on the back side of the substrate support, opposite to the side carrying the electrically active layers, to achieve the desired photoreceptor flatness.

One type of multi-layered photoreceptor that has been employed as a belt in electrophotographic imaging systems comprises a substrate, a conductive layer, a charge blocking layer, a charge generating (photogenerating) layer, and a charge transport layer. The charge transport layer often comprises an activating small molecule dispersed or dissolved in a polymeric film forming binder. Generally, the polymeric film forming binder in the transport layer is electrically inactive by itself and becomes electrically active when it contains the activating molecule. The expression "electrically active" means that the material is capable of supporting the injection of photogenerated charge carriers from the material in the charge generating layer and is capable of allowing the transport of these charge carriers through the electrically active layer in order to discharge a surface charge on the active layer. The multi-layered type of photoreceptor may also comprise additional layers such as an anti-curl backing layer, required when layers possess different coefficient of thermal expansion values, an adhesive layer, and an overcoating layer. Commercial high quality photoreceptors have been produced which utilize an anti-curl coating.

As more advanced, complex, highly sophisticated, electrophotographic copiers, duplicators and printers are developed, greater demands are placed on the photoreceptor to meet stringent requirements for the production of high quality images. To enhance photoreceptor performance, it is desirable to enhance the electrical properties of the photoreceptor. Charge generation layer sensitivity is one particular parameter that is desirable to enhance or improve for improved photoreceptor performance.

One way to enhance charge generation layer sensitivity is by the composition of the photogenerating pigment. For example, the sensitivity of the charge generation layer may be enhanced by mixing high and low sensitivity pigments.

Other attempts to enhance the sensitivity of the charge generation layer have included doping the charge generation layer with electron transporting materials (ETMs). That is, electron transports are physically mixed with a composition comprising a photogenerating pigment and a polymeric binder. Doping the charge generating layer with an electron transport material, however, is limited in its effectiveness to tune or enhance the sensitivity of the charge generation layer. Without being bound to any particular theory, the limited or variable results achieved by doping the charge generation layer with electron transport materials may be due to dispersion-distribution problems. In particular, the tuning effect achieved by physical addition of electron transport materials to a charge generation layer composition may be compromised by the distance between the electron transport materials and the pigment within the solution. That is, because they are free to move around in solution and during the coating process, the electron transport materials do not end up in close enough proximity to the pigment in the final coating to have a significant effect on the sensitivity of the charge generation layer.

It is therefore desirable to provide a charge generation layer with enhanced sensitivity. It is further desirable to provide a way to tune or selectively enhance the sensitivity of a charge generation layer. Along these lines, it is desirable to provide a charge generation layer composition having enhanced sensitivity in a photoconductive imaging member.

BRIEF DESCRIPTION

The present disclosure relates, in embodiments thereof, to a photoconducting imaging member comprising a substrate; an optional hole blocking layer; a charge generating layer; and a charge transport layer, wherein said charge generating layer comprises a photogenerating pigment and a binder, said binder comprising an ETM-modified binder comprising an electron transport material chemically attached to a polymeric binder material.

Additionally, the present disclosure is also directed to, in embodiments thereof, a photoconducting imaging member comprising a substrate; an optional hole blocking layer; a charge generating layer; and a charge transport layer, wherein said charge generating layer comprises a photogenerating pigment and a binder, said binder comprising an ETM-modified binder material comprising an electron transport material having at least one of a carboxylic acid or ester functional group grafted to a polymeric binder material having at least one OH group.

Moreover, the present disclosure concerns, in embodiments thereof, a photoconductive imaging member comprising a substrate; an optional hole blocking layer; a charge generating layer comprising a photogenerating pigment and a binder; and a charge transport layer, wherein said binder comprises an ETM-modified binder material comprising an electron transport material chemically attached to a polymeric binder material, said electron transport material being selected from the group consisting of carboxy fluorenone malonitrile and derivatives thereof, a nitrated fluorenone, N,N'-disubstituted-1,4,5,8-naphthalene tetracarboxylic diimides, N,N'-disubstituted-1,7,8,13-perylene tetracarboxylic diimides, carboxybenzyl naphthaquinones, and combinations thereof, and said polymeric binder material comprises at least one OH functional group.

These and other non-limiting characteristics of the development are more particular disclosed below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

The present disclosure is directed to a photoconductive imaging member comprising a charge generation layer composition with enhanced sensitivity. More specifically, the present disclosure relates to a charge generation layer comprising a photogenerating pigment and a binder, wherein the binder comprises a polymeric binder material having an electron transporting material chemically attached thereto.

Also included within the scope of the present disclosure are methods of imaging and printing with the photoresponsive devices illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697; and, 4,338,390, the disclosures of which are totally incorporated herein by reference, subsequently transferring the image to a suitable substrate, and permanently affixing the image thereto.

Figure 1:
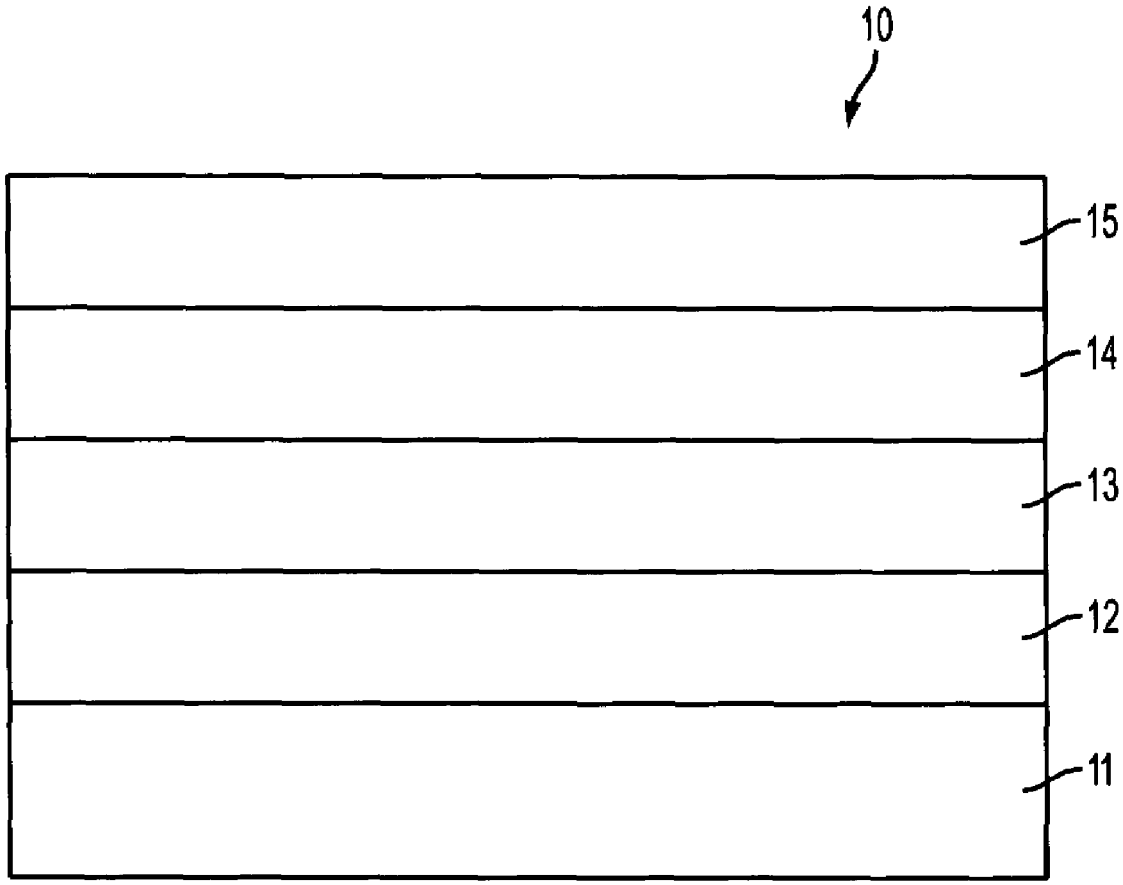
FIG. 1 is a schematic cross-sectional view of a photoreceptor comprising a charge generation layer in accordance with the present disclosure.

Generally, electrophotographic imaging members comprise a supporting substrate, having an electrically conductive surface or coated with an electrically conductive layer, an optional charge blocking layer, an undercoat layer, a charge generating layer, a charge transport layer and an optional overcoating layer. FIG. 1 displays a suitable configuration of a photoreceptor in accordance with the present disclosure. The configuration in FIG. 1 is merely exemplary. It will be appreciated by persons skilled in the art that other configurations may be possible.

With reference to FIG. 1, a photoreceptor 10 comprises a substrate 11, an optional hole blocking layer 12, a charge generating layer 13, a charge transport layer 14, and an optional overcoat layer 15. The charge generating layer 13 includes a photogenerating pigment and a binder, wherein the binder includes a modified binder comprising a polymeric binder material and an electron transport material chemically attached thereto. The charge generation layer composition comprising a binder having an electron transport material chemically attached thereto is further described herein.

The substrate may be opaque or substantially transparent and may comprise numerous suitable materials having the required mechanical properties. Accordingly, the substrate may comprise a layer of an electrically non-conductive or conductive material such as an inorganic or an organic composition. The electrically conductive layer may comprise the entire supporting substrate or merely be present as a coating on an underlying rigid or flexible web member. Any suitable electrically conductive material may be utilized. Typical electrically conductive materials include, for example, aluminum, titanium, nickel, chromium, brass, gold, stainless steel, copper iodide, and the like. When the conductive layer is to be flexible, it may vary in thickness over substantially wide ranges depending on the desired use of the electrophotoconductive member. Accordingly, the conductive layer can generally range in thicknesses of from about 50 Angstrom to about 150 micrometers. As electrically non-conducting materials there may be employed various thermoplastic and thermoset resins known for this purpose including polyesters, polycarbonates, polyamides, polyurethanes, and the like. The substrate may have any suitable shape such as, for example, a flexible web, rigid cylinder, sheet and the like.

The thickness of a flexible substrate support depends on numerous factors, including economical considerations, and thus this layer for a flexible belt may be of substantial thickness such as, for example, over 200 micrometers, or of minimum thickness such as less than 50 micrometers, provided there are no adverse affects on the final photoconductive device.

Optionally, a photoreceptor includes a hole blocking layer. Any suitable hole blocking layer capable of forming an electronic barrier to holes between the adjacent photoconductive layer and the underlying conductive layer may be utilized. A hole blocking layer may comprise any suitable material. Typical hole blocking layers utilized for the negatively charged photoreceptors may include, for example, Luckamide, hydroxy alkyl methacrylates, nylons, gelatin, hydroxyl alkyl cellulose, organopolyphosphazines, organosilanes, organotitanates, organozirconates, silicon oxides, zirconium oxides, and the like. In embodiments, the hole blocking layer comprises nitrogen containing siloxanes. Typical nitrogen containing siloxanes are prepared from coating solutions containing a hydrolyzed silane. Typical hydrolyzable silanes include 3-aminopropyl triethoxysilane, (N,N'-dimethyl 3-amino) propyl triethoxysilane, N,N-dimethylamino phenyl triethoxy silane, N-phenyl aminopropyl trimethoxy silane, trimethoxy silylpropyldiethylene triamine and mixtures thereof.

During hydrolysis of the amino silanes described above, the alkoxy groups are replaced with hydroxyl group. An example of a particularly suitable blocking layer comprises a reaction product between a hydrolyzed silane and the oxidized surface of an underlying conductive layer which inherently forms on the surface of conductive a metal layer when exposed to air after deposition. This combination reduces spots at time 0 and provides electrical stability at low relative humidity. The imaging member is prepared by depositing on the conductive layer of a coating of an aqueous solution of the hydrolyzed silane at a pH between about 4 and about 10, drying the reaction product layer to form a siloxane film and applying electrically active layers, such as a photogenerator layer and a hole transport layer, to the siloxane film.

The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like. This siloxane coating is described in U.S. Pat. No. 4,464,450, the disclosure of which is incorporated by reference herein in its entirety. After drying, the siloxane reaction product film formed from the hydrolyzed silane contains larger molecules. The reaction product of the hydrolyzed silane may be linear, partially crosslinked, a dimer, a trimer, and the like.

A suitable charge blocking layer may be fabricated from a solution of zirconium butoxide and gamma-amino propyl tri-methoxy silane in a suitable solvent such as a mixture of anisisopropyl alcohol, butyl alcohol and water. Generally, an exemplary solution comprises between about 70 and about 90 by weight of zirconium butoxide and between about 30 and about 10 by weight of gamma-amino propyl tri-methoxy silane, based on the total weight of solids in the solution.

The blocking layer should be continuous and have a thickness of less than about 0.5 micrometer because greater thicknesses may lead to undesirably high residual voltage. A blocking layer of between about 0.005 micrometer and about 0.3 micrometer (50 Angstroms-3000 Angstroms) is desirable because charge neutralization after the exposure step is facilitated and optimum electrical performance is achieved. A thickness of between about 0.03 micrometer and about 0.06 micrometer is desirable for metal oxide layers for optimum electrical characteristics.

Any suitable undercoat layer may be applied to the charge blocking layer. Undercoat layer materials are well known in the art. Typical undercoat layer materials include, for example, polyesters, MOR-ESTER 49,000 (available from Morton International Inc.), Vitel PE-100, Vitel PE-200, Vitel PE-200D, and Vitel PE-222 (all Vitels available from Goodyear Tire and Rubber Co.), polyarylates (e.g., Ardel, available from AMOCO Production Products), polysulfone (available from AMOCO Production Products), polyurethanes, and the like. The MOR-ESTER 49,000 polyester resin is a linear saturated copolyester reaction product of ethylene. glycol with terephthalic acid, isophthalic acid, adipic acid and azelaic acid. Other polyester resins which are chemically similar to the 49,000 polyester resin and which are also suitable for a photoreceptor undercoat layer coating include Vitel PE-100 and Vitel PE-200, both of which are available from Goodyear Tire & Rubber Co. Other examples of suitable undercoat layer materials include, but are not limited to, a polyamide such as Luckamide 5003 from Dai Nippon Ink, Nylon 8 with methylmethoxy pendant groups, CM 4000 and CM 8000 from Toray Industries Ltd and other N-methoxymethylated polyamides, such as those prepared according to the method described in Sorenson and Campbell "Preparative Methods of Polymer Chemistry" second edition, pg 76, John Wiley and Sons Inc., 1968, and the like and the mixtures thereof. These polyamides can be alcohol soluble, for example, with polar functional groups, such as methoxy, ethoxy and hydroxy groups, pendant from the polymer backbone. Any suitable alcohol solvent or solvent mixtures may be employed to form a coating solution. Typical solvents include methanol, ethanol, propanol and mixtures thereof. Water may optionally be added to the solvent mixture. Satisfactory results may be achieved with a dry undercoat layer thickness between about 0.05 micrometer and about 0.3 micrometer. Conventional techniques for applying an undercoat layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like. In some embodiments, the undercoat layer functions as a blocking layer and there is no need for a separate blocking layer beneath the undercoat layer.

The charge generation (or photogenerating) layer includes a pigment and a binder in accordance with the present disclosure. The pigment is not critical and may include any suitable photogenerating pigment. A wide variety of materials known in the art as charge generation materials can be employed including inorganic and organic compounds. Suitable inorganic compounds include, for example, zinc oxide, lead oxide, and selenium. Suitable organic materials include various particulate organic pigment materials, such as phthalocyanine pigments, and a wide variety of soluble organic compounds including metallo-organic and polymeric organic charge generation materials. A partial listing of representative materials may be found, for example, in Research Disclosure, Vol. 109, May, 1973, page 61, in an article entitled "Electrophotographic Elements, Materials and Processes", at paragraph IV (A) thereof. This partial listing of well-known charge generation materials is hereby incorporated by reference.

Examples of suitable organic charge generation materials include phthalocyanine pigments such as a bromoindium phthalocyanine pigment described in U.S. Pat. Nos. 4,666,802 and 4,727,139 or a titanylphthalocyanine pigment such as a titanyl tetrafluoropthalocyanine described in U.S. Pat. No. 4,701,396; various pyrylium dye salts, such as pyrylium, bispyrylium, thiapyrylium, and selenapyrylium dye salts, as disclosed, for example, in U.S. Pat. No. 3,250,615; fluorenes, such as 7,12-dioxo-13-dibenzo (a,h) fluorene, and the like; aromatic nitro compounds of the kind disclosed in U.S. Pat. No. 2,610,120; anthrones such as those disclosed in U.S. Pat. No. 2,670,284; quinones such as those disclosed in U.S. Pat. No. 2,670,286; thiazoles, such as those disclosed in U.S. Pat. No. 3,732,301; various dyes such as cyanine (including carbocyanine), merocyanine, triarylmethane, thiazine, azine, oxazine, xanthene, phthalein, acridine, azo, anthraquinone dyes, and the like, and mixtures thereof. The photogenerating layer can contain, for example, known photogenerating pigments, such as metal phthalocyanines, metal free phthalocyanines, alkylhydroxyl gallium phthalocyanine, hydroxygallium phthalocyanines, perylenes, especially bis (benzimidazo)perylene, titanyl phthalocyanines, and the like. Some specific examples of suitable pigments include, but are not limited to, vanadyl phthalocyanines, Type V hydroxygallium phthalocyanines, and inorganic components such as selenium, selenium alloys, and trigonal selenium.

The photogenerating pigment is dispersed in a binder. A binder in accordance with the present disclosure includes a polymeric binder material having an electron transporting material chemically attached thereto. A binder material having an electron transport material chemically attached thereto is also referred to herein as an ETM-modified binder (material). In embodiments, the electron transport material is chemically attached to the polymeric binder material in any suitable manner including, for example, grafting the electron transport material to the polymeric binder material.

The polymeric binder material suitable for use in an ETM-modified binder in accordance with the present disclosure may be any polymeric binder material comprising OH functional groups. Examples of suitable polymeric binder materials include, but are not limited to, poly(vinyl chloride-co-vinyl acetate-co-2-hydroxypropyl acrylate-co-maleic acid); terpolymers of polyvinyl chloride, polyvinyl acetate, and polyhydroxypropyl acrylate; terpolymers of polyvinyl butyral, polyvinyl alcohol, and polyvinyl acetate; polyvinyl alcohol and its copolymers with cyanoethyl polyvinyl alcohol, and the like.

Another non-limiting example of a polymeric material suitable for use in an ETM-modified binder includes polymers of the formula:

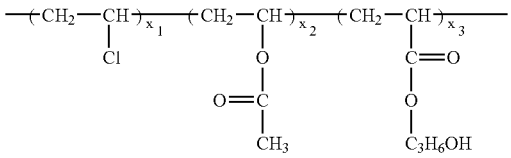

wherein $x_1$, $x_2$ and $x_3$ represent the molar percentage of each component in the polymer, and the sum of $x_1$, $x_2$ and $x_3$ is equal to 1. A specific example of a suitable polymer includes VAGF®, which is available from The Dow Chemical Company and having the formula:

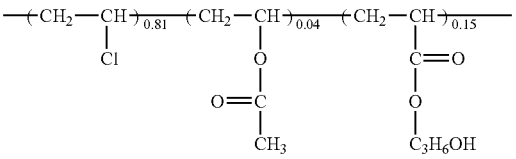

Still other non-limiting examples of suitable polymeric binder materials for use in an ETM-modified binder in accordance with the present disclosure includes the UCAR® series of polymers available from Dow Chemical and having the following formula:

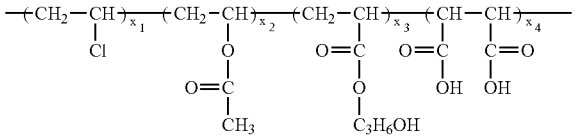

wherein $x_1$, $x_2$, $x_3$ and $x_4$ represent the molar percentage of each component in the polymer and the sum of $x_1$, $x_2$, $x_3$ and $x_4$ is equal to 1. A particularly suitable UCAR® polymer is UCARMAG®-527 having the formula:

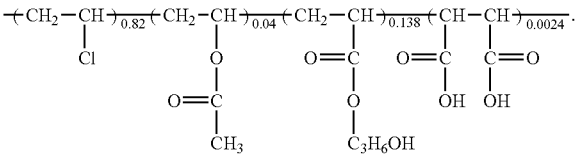

In still other embodiments, the polymeric binder material employed in an ETM-modified binder may be a terpolymer of vinyl butyral, vinyl alcohol, and vinyl acetate. Such terpolymers typically have the formula of:

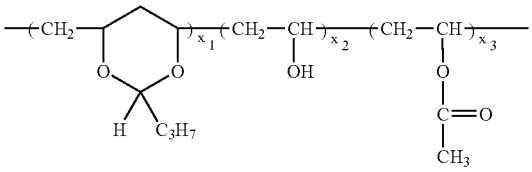

wherein $x_1$, $x_2$ and $x_3$ represent the molar percentage of each component in the polymer and the sum of $x_1$, $x_2$ and $x_3$ is equal to 1. Examples of suitable terpolymers of vinyl butyral, vinyl alcohol, and vinyl acetate include, but are not limited to, polymers in the Butvar series available from Solutia, and S-Lec polymers in the BM- or BL-series available from Sekisui Chemical.

In still other embodiments, the polymeric binder material employed in an ETM-modified binder may be a copolymer of vinyl alcohol and cyanoethyl vinyl alcohol. Such copolymers typically have the formula of:

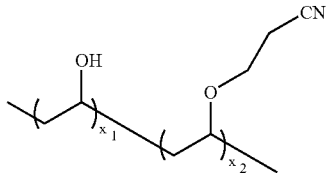

wherein $x_1$ and $x_2$ represent the molar percentage of each component in the polymer and the sum of $x_1$ and $x_2$ is equal to 1. Examples of suitable copolymers of vinyl alcohol and cyanoethyl vinyl alcohol include, but are not limited to, CyanoResin series available from Shin-Etsu Chemical Co., Ltd.

The electron transport materials chemically attached to the polymeric binder material may be any electron transporting material having a carboxylic acid or ester functionality. Examples of suitable electron transporting materials include, but are not limited to, carboxyflurenone malonitrile and derivatives thereof, nitrated fluorenone derivatives, N-N'-disubstituted-1,4,5,8-naphthalene tetracarboxylic diimides, N,N'-disubstituted-1,7,8,13-perylenetetracarboxylic diimides, carboxybenzyl naphthaquinones, and the like.

Suitable electron transport components which generally possess functional carboxylic acid or carboxylate groups include carboxyfluorenone malononitrile (CFM) derivatives represented by the general structural formula:

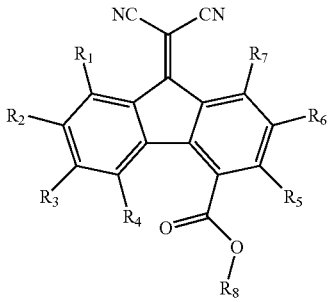

wherein each R is independently selected from the group consisting of hydrogen, alkyl having 1 to about 40 carbon atoms (for example is intended throughout with respect to the number of carbon atoms), alkoxy having 1 to about 40 carbon atoms, phenyl, substituted phenyl, higher aromatics, such as naphthalene and anthracene, alkylphenyl having about 6 to about 40 carbon atoms, alkoxyphenyl having about 6 to about 40 carbon atoms, aryl having about 6 to about 30 carbon atoms, substituted aryl having about 6 to about 30 carbon atoms, and halogen. Non-limiting examples of specific carboxy fluorenone malonitrile derivatives suitable as the electron transport material to be chemically attached to a polymeric binder material include carboxy fluorenone malonitrile (CFM) represented by the formula

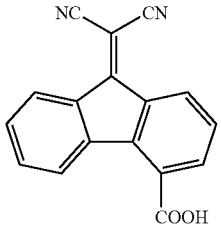

and n-butyl 9-dicyanomethylenefluorenone-4-carboxylate (BCFM) represented by the formula:

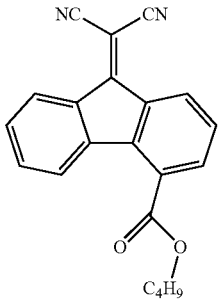

Another example of a suitable electron transport material to attach to a polymeric binder is a nitrated fluorenone derivative represented by

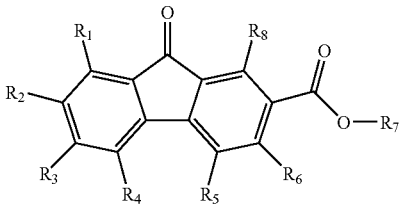

wherein each R is independently selected from the group consisting of hydrogen, alkyl, alkoxy, aryl, such as phenyl, substituted phenyl, higher aromatics, such as naphthalene and anthracene, alkylphenyl, alkoxyphenyl, carbons, substituted aryl and halogen, and wherein at least two R groups are nitro. A non-limiting example of a suitable nitrated fluorenone derivative includes 4,5,7-trinitro-9-fluorenone-2-carboxylate.

Other suitable electron transport materials for an ETM-modified binder in a present charge generating layer include N,N'-disubstituted-1,4,5,8-naphthalenetetra-carboxylic diimides represented by the general formula/structure

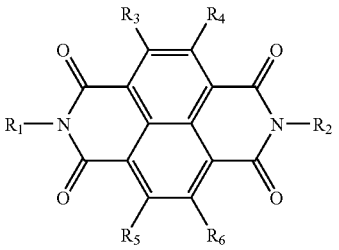

wherein $R_1$ is, for example, substituted or unsubstituted alkyl, branched alkyl, cycloalkyl, alkoxy or aryl, such as phenyl, naphthyl, a polycyclic aromatic, such as anthracene, wherein $R_1$ and $R_2$ are equivalent groups; $R_2$ is alkylcarboxylic acid or its ester derivatives, branched alkylcarboxylic acid or its ester derivatives, cycloalkylcarboxylic acid or its ester derivatives, arylcarboxylic acid or its ester derivatives, such as phenylcarboxylic acid or its ester derivatives, naphthylcarboxylic acid or its ester derivatives, or a polycyclic aromatic carboxylic acid or its ester derivatives, such as anthracenecarboxylic acid or its ester derivatives; and $R_1$ and $R_2$ can independently possess from 1 to about 50 carbon atoms, and more specifically, from 1 and about 12 carbon atoms. At least one of $R_1$ or $R_2$ contains a substituent comprising a carboxylic acid group and/or an ester derivative thereof. $R_3$, $R_4$, $R_5$ and $R_6$ are, for example, independently, alkyl, branched alkyl, cycloalkyl, alkoxy or aryl, such as phenyl, naphthyl, polycyclic aromatics, such as anthracene, or halogen and the like.

A non-limiting example of a suitable N,N'-disubstituted-1,4,5,8-naphthalenetetracarboxylic diimide includes N-pentyl,N'-propylcarboxyl 1,4,5,8-naphthalenetetracarboxylic diimide (PPCNTDI) represented by the following formula

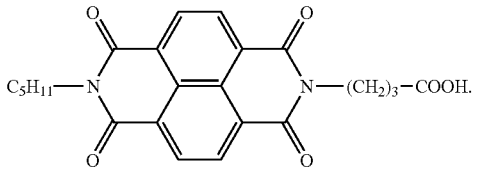

Suitable N,N'-disubstituted-1,7,8,13-perylenetetracarboxylic diimides include those represented by the formula

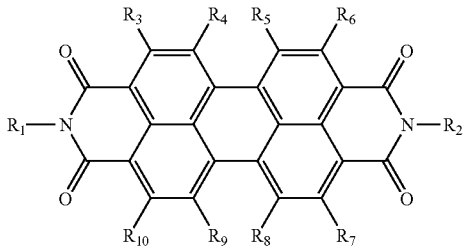

wherein $R_1$ is, for example, substituted or unsubstituted alkyl, branched alkyl, cycloalkyl, alkoxy or aryl, such as phenyl, naphthyl, a polycyclic aromatic, such as anthracene, wherein $R_1$ and $R_2$ are equivalent groups; $R_2$ is alkylcarboxylic acid or its ester derivatives, branched alkylcarboxylic acid or its ester derivatives, cycloalkylcarboxylic acid or its ester derivatives, arylcarboxylic acid or its ester derivatives, such as phenylcarboxylic acid or its ester derivatives, naphthylcarboxylic acid or its ester derivatives, or a polycyclic aromatic carboxylic acid or its ester derivatives, such as anthracenecarboxylic acid or its ester derivatives; and $R_1$ and $R_2$ can independently possess from 1 to about 50 carbon atoms, and more specifically, from 1 and about 12 carbon atoms. At least one of $R_1$ or $R_2$ contains a substituent comprising a carboxylic acid group and/or an ester derivative thereof. $R_3$, $R_4$, $R_5$ $R_6$, $R_7$, $R_8$, $R_9$, and $R_{10}$ are, for example, independently, alkyl, branched alkyl, cycloalkyl, alkoxy or aryl, such as phenyl, naphthyl, polycyclic aromatics, such as anthracene, or halogen and the like. An example of a suitable N,N'-disubstituted-1,7,8,13-perylenetetracarboxylic diimide is N-(1-methyl)hexyl,N'- propyl-carboxyl-1,7,8,13-perylenetetracarboxylic diimide (1-MHPCPTDI) represented by the following formula

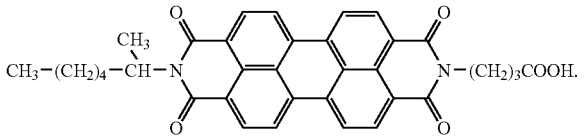

Still other electron transport materials suitable for chemically attaching to a polymeric binder material include a carboxybenzyl naphthaquinone electron transport represented by the following general formula/structure:

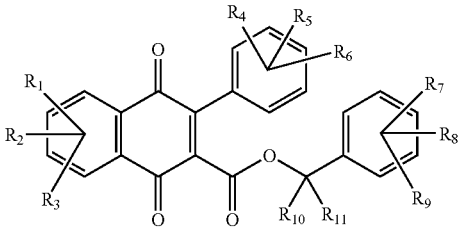

wherein each R is independently selected from the group consisting of hydrogen, alkyl with 1 to about 40 carbon atoms, alkoxy with 1 to about 40 carbon atoms, phenyl, substituted phenyl, higher aromatics, such as naphthalene and anthracene, alkylphenyl with about 6 to about 40 carbon atoms, alkoxyphenyl with about 6 to about 40 carbon atoms, aryl with about 6 to about 30 carbon atoms, substituted aryl with about 6 to about 30 carbon atoms, and halogen. An example of a specific carboxybenzyl naphthaquinone is a carboxybenzylnaphthaquinone (CBNQ) represented by the following formula

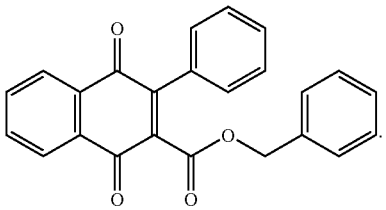

Yet another example of a suitable electron transport material for attaching to a polymeric CG binder in accordance with the present disclosure is a 1,1'-dioxo-2-(aryl)-6-phenyl-4-(dicyanomethylidene)thiopyran derivative represented by the general structure:

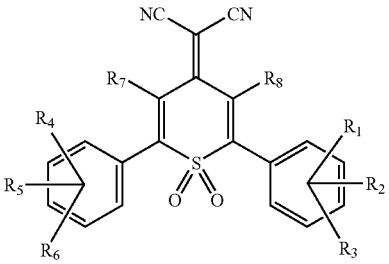

wherein each R is independently selected from the group consisting of hydrogen, alkyl having 1 to 40 carbon atoms, alkoxy having 1 to 40 carbon atoms, phenyl, substituted phenyl, higher aromatic such as naphthalene and anthracene, alkylphenyl having 6 to 40 carbon atoms, alkoxyphenyl having 6 to 40 carbon atoms, aryl having 6 to 30 carbon atoms, substituted aryl having 6 to 30 carbon atoms and halogen, and at least one of the R groups comprises a carboxylic acid group or ester derivative thereof. An example of a suitable a 1,1'-dioxo-2-(aryl)-6-phenyl-4-(dicyanomethylidene)thiopyran derivative is a compound of the formula

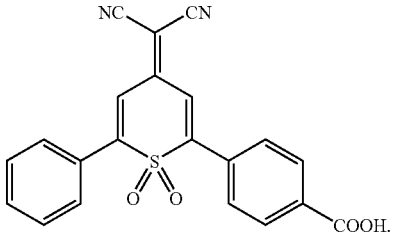

An ETM-modified binder, comprising an electron transport material chemically attached to a polymeric binder material, suitable for use in a charge generating layer material may be made by a transesterification reaction and chemically attaching a modified electron transport material to a polymeric binder material. In one embodiment, an electron transport material containing a carboxylic acid group is converted to an acid chloride by reacting the electron transport material with a thionyl chloride. The acid chloride derivative of the electron transport material is then dissolved in a solvent and added to a OH-containing polymeric binder solution and reacted to yield an ETM-modified binder with formation of ester bonds. In another embodiment, an electron transport material containing an ester group is dissolved in a solvent and added to a solution of a HO-containing polymer, thus transesterification reaction takes place and the ETM is chemically grafted onto the polymeric binder with formation of ester bonds.

In embodiments, an ETM-modified binder in accordance with the present disclosure may have an electron transport material chemically attached to from 1 to all of the available OH groups on the polymeric binder material. While using the term "grafting", the phrase grafting density does not define or limit the manner in which the electron transport materially is chemically attached to a polymeric binder material. That is, while an ETM-modified binder will have what is defined herein as a grafting density, the electron transport materially is not necessarily chemically attached to the polymeric binder materially by grafting.

A charge generation layer in accordance with the present disclosure may have a pigment to binder ratio of from about 95:5 to about 5:95 on a weight percent basis, including from about 70:30 to about 30:70 on a weight percent basis. In embodiments, the binder solely comprises an ETM-modified binder. In other embodiments the binder comprises a mixture of different ETM-modified binders. In still other embodiments, the binder may comprise a mixture of ETM-modified binder(s) and unmodified binder. As used herein, an unmodified binder is any binder material that does not include an electron transport material chemically attached thereto. Where the binder is a mixture of ETM-modified binder and unmodified binder, the ratio of ETM-modified binder to unmodified binder may be from about 99:1 to about 1:99 weight percent of the overall binder composition. Where the binder comprises a mixture of an ETM-modified binder in accordance with the present disclosure and an unmodified binder material, the unmodified binder material may be any binder material suitable for use in a charge generation layer. Examples of suitable (ungrafted) binder materials include, but are not limited to, poly(vinyl butyral), poly(vinyl carbazole), polyesters, polycarbonates, poly(vinyl chloride), polyacrylates and methacrylates, copolymers of vinyl chloride and vinyl acetate, phenoxy resins, polyurethanes, poly(vinyl alcohol), polyacrylonitrile, polystyrene, and the like.

The coating of the charge generating layer can be accomplished with spray, dip or wire-bar methods such that the final dry thickness of the photogenerator layer is, for example, from about 0.01 to about 30 microns, and more specifically, from about 0.1 to about 15 microns after being dried at, for example, about 40° C. to about 150° C. for about 15 to about 90 minutes. It is desirable to select a coating solvent that does not substantially disturb or adversely affect the other previously coated layers of the device. Examples of solvents that can be selected for use as coating solvents for the photogenerator layers are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The charge transport layer is not critical and may comprise any suitable charge transport layer composition. The charge transport layer is applied over the charge generation layer.

Any suitable electron transport material may be used in the charge generating layer. Examples of suitable electron transport materials include those previously described with reference to the present ETM-modified binder materials. Another non-limiting example of a suitable transport material for the charge transport layer includes A diphenoquinone represented by the following general structure:

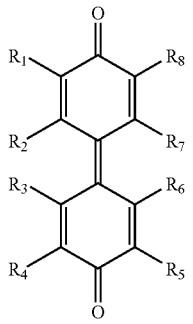

and mixtures thereof, wherein each R is independently selected from the group consisting of hydrogen, alkyl having 1 to 40 carbon atoms, alkoxy having 1 to 40 carbon atoms, phenyl, substituted phenyl, higher aromatic such as naphthalene and anthracene, alkylphenyl having 6 to 40 carbon atoms, alkoxyphenyl having 6 to 40 carbon atoms, aryl having 6 to 30 carbon atoms, substituted aryl having 6 to 30 carbon atoms and halogen. Suitable known electron transport agents include 2,4,7-trinitro-9-fluorenone, substituted 4-dicyanomethylene-4H-thiopyran 1,1-dioxides, and substituted anthraquinone biscyanoimines.

Further suitable charge transport compounds that can be selected for the charge transport layer include aryl amines of the following formula

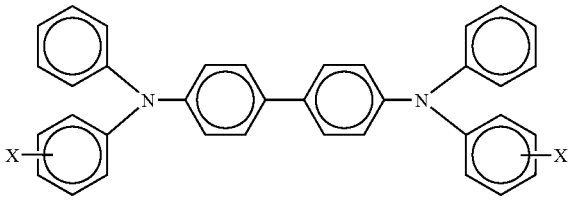

and wherein the thickness thereof is, for example, from about 5 microns to about 75 microns, or from about 10 microns to about 40 microns dispersed in a polymer binder, wherein X is an alkyl group, a halogen, or mixtures thereof, especially those substituents selected from the group consisting of Cl and $CH_3$.

Examples of specific aryl amines are N,N'-diphenyl-N,N'-bis(alkylphenyl)-1,1'-biphenyl-4,4'-diamine wherein alkyl is selected from the group consisting of methyl, ethyl, propyl, butyl, hexyl, and the like; and N,N'-diphenyl-N,N'-bis (halophenyl)-1,1'-biphenyl4,4'-diamine wherein the halo substituent is preferably a chloro substituent. Other known charge transport layer molecules can be selected, reference for example U.S. Pat. Nos. 4,921,773 and 4,464,450, the disclosures of which are totally incorporated herein by reference.

In the charge transport layer, the charge transport agent(s) are dispersed, and may be dissolved, in an electrically insulating organic polymeric film forming binder. In general, any of the polymeric binders useful in the photoconductor element art can be used, including, for example, the unmodified binders described above for use in a charge generation layer. Examples of suitable binder materials selected for the transport layers include components, such as those described in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes and epoxies, and block, random or alternating copolymers thereof. A specific electrically inactive binder is comprised of polycarbonate resins having molecular weight of from about 20,000 to about 100,000, and in some embodiments, a molecular weight of from about 50,000 to about 100,000. Generally, the transport layer contains from about 10 to about 75 percent by weight of the charge transport material. In embodiments, the transport layer contains from about 35 percent to about 50 percent of the binder material. Additionally, the charge transport layer can utilize a polymeric binder which itself is a charge transport agent. Examples of such polymeric binders include poly (vinylcarbazole). Exemplary binders include polycarbonates such as bisphenol A polycarbonate, bisphenol Z polycarbonate, and polyesters such as poly[4,4'-(2-norbornylidene) bisphenylene azelate-co-terephthalate(60/40)].

On a 100-weight percent total solids basis, a charge transport layer comprises for example about 10 to about 70 weight percent of an electron transport material and about 30 to about 90 weight percent of binder. Typically, a charge transport layer has a thickness in the range of about 10 to about 25 microns, although thicker and thinner layers can be employed.

A charge transport layer can be produced in a bipolar form, if desired, by additionally incorporating into the layer at least one hole transport agent. Such an agent preferentially accepts and transports positive charges (holes). If employed, the quantity of hole transport agent(s) present in a charge transport layer on a total layer weight basis may be in the range of about 10 to about 50 weight percent, although larger and smaller quantities can be employed.

Examples of suitable organic hole transport agents known to the prior art include: carbazoles including carbazole, N-ethyl carbazole, N-isopropyl carbazole, N-phenyl carbazole, halogenated carbazoles, various polymeric carbazole materials such as poly(vinyl carbazole), halogenated poly (vinyl carbazole), and the like; arylamines including monoarylamines, diarylamines, triarylamines and polymeric arylamines. Specific arylamine organic photoconductors include the nonpolymeric triphenylamines illustrated in U.S. Pat. No. 3,180,730; the polymeric triarylamines described in U.S. Pat. No. 3,240,597; the triarylamines having at least one of the aryl radicals substituted by either a vinyl radical or a vinylene radical having at least one active hydrogen-containing group, as described in U.S. Pat. No. 3,567,450; the triarylamines in which at least one of the aryl radicals is substituted by an active hydrogen-containing group, as described by U.S. Pat. No. 3,658,520; and tritolylamine; polyarylakanes of the type described in U.S. Pat. Nos. 3,274,000; 3,542,547; 3,625,402; and 4,127,412; strong Lewis bases, such as aromatic compounds, including aromatically unsaturated heterocyclic compounds free from strong electron-withdrawing groups. Examples include tetraphenylpyrene, 1-methylpyrene, perylene, chrysene, anthracene, tetraphene, 2-phenyinaphthalene, azapyrene, fluorene, fluorenone, 1-ethylpyrene, acetyl pyrene, 2,3-benzochrysene, 3,4-benzopyrene, 1,4-bromopyrene, phenylindole, polyvinyl carbazole, polyvinyl pyrene, polyvinyltetracene, polyvinyl perylene and polyvinyl tetraphene; hydrazones, including the dialkyl-substituted aminobenzaldehyde-(diphenylhydrazones) of U.S. Pat. No. 4,150,987; alkylhydrazones and arylhydrazones as described in U.S. Pat. Nos. 4,554,231; 4,487,824; 4,481,271; 4,456,671; 4,446,217; and 4,423,129, which are illustrative of the hydrazone hole transport agents; other useful hole transport agents are described in Research Disclosure, Vol. 109, May, 1973, pages 61-67 paragraph IV(A)(2) through (13).

In addition to charge transport agent(s) and a binder polymer, the charge transport layer may contain various optional additives, such as surfactants, levelers, plasticizers, and the like. On a 100 weight percent total solids basis, a charge transport layer can contain for example up to about 15 weight percent of such additives, although it may contain less than about 1 weight percent of such additives.

Coating of the charge transport layer composition over the charge generation layer can be accomplished using a solution coating technique such as knife coating, spray coating, spin coating, extrusion hopper coating, curtain coating, and the like. After coating, the charge transport layer composition is usually air-dried and then oven-dried.

Photoreceptors with a charge generation layer that includes a binder comprising an ETM-modified binder exhibit enhanced charge generation layer sensitivity. In some embodiments, the sensitivity may be increased by as much as 10% relative to photoreceptors that do not include an ETM-modified binder. Charge generation sensitivity may be tuned by changing the electron transport material that is chemically attached to the polymeric binder material and/or the grafting density. Further, tuning charge generation sensitivity with a binder comprising an electron transport material chemically attached to a polymeric binder material is more flexible as compared to using binders or charge generating layers doped (i.e., physically mixed) with an electron transport material. Use of a binder in accordance with the present disclosure in a charge generation layer also reduces the severity of other problems including, but not limited to, ghosting, CDS, background and cyclic stability.

Processes of imaging, especially xerographic imaging and printing, including digital, are also encompassed by the present disclosure. More specifically, the layered photoconductive imaging members of the present disclosure can be selected for a number of different known imaging and printing processes including, for example, electrophotographic imaging processes, especially xerographic imaging and printing processes wherein charged latent images are rendered visible with toner compositions of an appropriate charge polarity. The imaging members as indicated herein are in embodiments sensitive in the wavelength region of, for example, from about 500 to about 900 nanometers, and in particular from about 650 to about 850 nanometers, thus diode lasers can be selected as the light source. Moreover, the imaging members of this disclosure are useful in color xerographic applications, particularly high-speed color copying and printing processes.

The following examples are for the purpose of further illustrating a photoconductive imaging member having a charge generation that includes a binder comprising an electron transport material chemically attached to a polymeric binder material. The examples are merely illustrative and not intended to be limiting in any manner.

EXAMPLES

Preparation of ETM-Modified Binder.

An electron transport material grafted binder was prepared as follows. 5.1 grams of 9-dicyanomethylenefluorene-4-carboxylate (CFM) was mixed with 11.9 grams of thionyl chloride under argon gas flow. The mixture was heated to slightly reflux for 24 hours and stirred with magnetic stirring. Unreacted thionyl chloride was evaporated off by vacuum and yellow crystals were obtained. Dry crystal product was dissolved in 150 ml of dry tetrahydrofuran (THF) and provided a yellowish solution. 30 grams of a random copolymer of vinyl chloride, vinyl acetate, maleic acid and hydroxypropyl acrylate sold under the trade name UCARMAG-527 in 200 ml of THF was slowly added to the yellowish solution. The mixture was then heated to 70° C. for 15 hours. After heating, the solution was cooled to room temperature and the cooled solution was later poured into 600 ml. of methanol with vigorous stirring. A yellowish solid was collected and dried and then purified once more by THF/methanol treatment. The purified solid was then dried under vacuum.

$^1$H-NMR shows that the resultant product is UCARMAG-527 having CFM grafted thereto. The chemical attachment of the CFM to the UCARMAG-527 is via ester linkages. The NMR shows that the UCARMAG-527 comprises about 2 mol percent of CFM grafted thereto, or about 15% of the HO groups are grafted with CTM moieties.

Preparation of Photoreceptors.

The imaging member includes a 30 mm diameter mirror aluminum substrate, a blocking or undercoating layer, a charge generating layer, and a charge transport layer.

The hole blocking layer is fabricated from a coating dispersion consisting of titanium dioxide ($TiO_2$ STR-60N, Sakai), silica (P-100, Esprit) and phenolic resin (Varcum 29159, OxyChem) in xylene/1-butanol (wt/wt=50/50). The weight ratio of titanium dioxide, silica, phenolic resin is 52/10/38. An aluminum drum substrate of 30 mm in diameter is dip-coated from a dip-coating tank containing the coating solution and dried at a temperature of 145° C. for 45 minutes. The resulting dry blocking layer has a thickness of about 4.0 micrometers.

The charge generator coating dispersion is prepared by dispersing 15 grams of hydroxygallium phthalocyanine (V) particles in a solution of 10 grams the above CFM-grafted UCARMAG-527 in 368 grams of n-butyl acetate. This dispersion is milled in an ATTRITOR with 1 mm glass beads for 3 hours. The drum with the hole blocking layer then is ring-coated with the charge generator coating dispersion. The resulting coated drum is air dried to form a 0.2~0.5-micrometer thick charge generating layer. A control charge generation layer composition was prepared using unmodified binder, UCARMAG-527 (available from Union Carbide Co.).

A charge transport layer is coated using a solution of a mixture of 60 weight % of PCZ400 (a polycarbonate, available from Mitsubishi Gas Chemical Company, Inc.), and 40 weight % of charge transport molecule N,N'-diphenyl-N,N'-bis(3-methylphenyl)-[1,1'-biphenyl]4,4'-diamine. The solution is in 70:30 by weight ratio of tetrahydrofuran:toluene solvent mixture, providing an approximate solids content of 23 33% by weight. The charge transport layer is dried at 120° C. for 40 minutes. The dried charge transporting layer thickness is about 26 microns.

Figure 2:
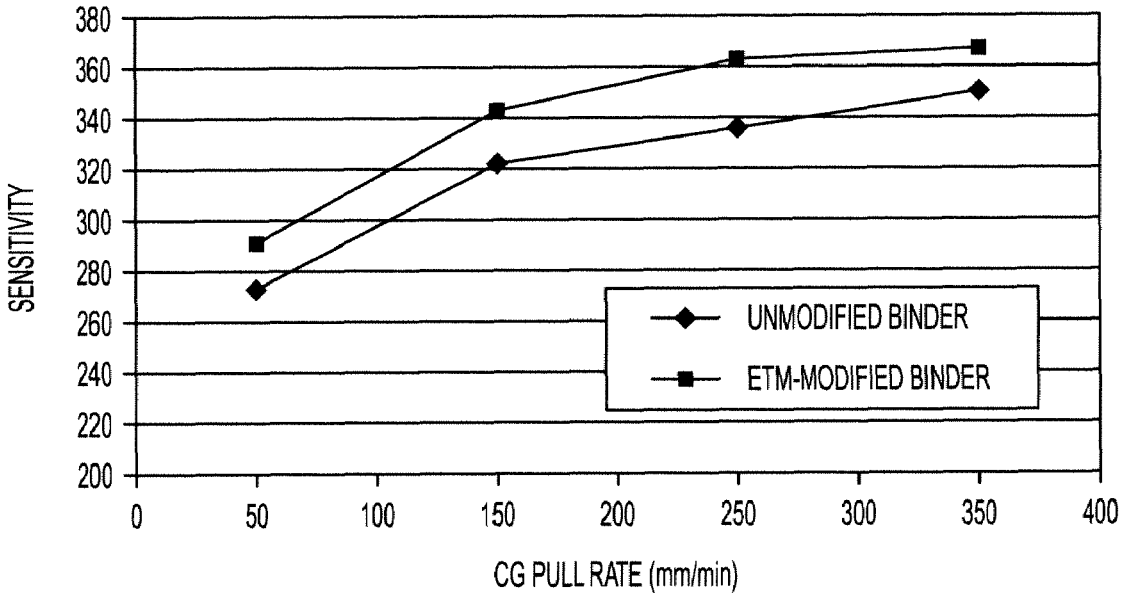
FIG. 2 is a graph comparing the sensitivity of a charge generation layer comprising an ETM-modified binder in accordance with the present disclosure to one comprising a conventional or unmodified binder.
Figure 3:
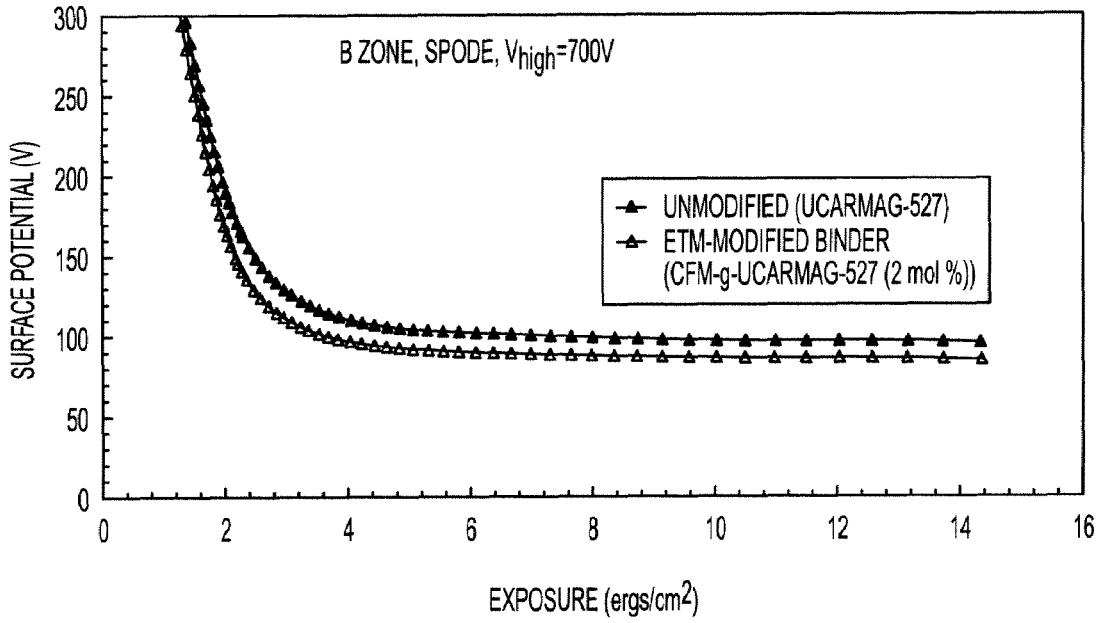
FIG. 3 is a partial PIDC comparing the effect on residual potential of an ETM-modified binder in accordance with the present disclosure to a conventional or unmodified binder.

As shown in FIG. 2, the photoreceptor employing the grafted binder material and the charge generation layer exhibited increased charge generation layer sensitivity as compared to the photoreceptor using the unmodified binder. As show in FIG. 3, the use of the ETM-modified binder and the charge generation layer lowers the residual potential of the photoreceptor and results in a sharper PIDC at the shoulder.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A photoconductive imaging member comprising:

a substrate;

an optional hole blocking layer;

a charge generating layer comprising a photogenerating pigment and a binder; and a charge transport layer, wherein said binder comprises an ETM-modified binder material comprising an electron transport material chemically attached to a polymeric binder material;

wherein the electron transport material is selected from the group consisting of carboxy fluorenone malonitrile and derivatives thereof, a nitrated fluorenone, N,N'-disubstituted-1,4,5,8-naphthalene tetracarboxylic diimides, N,N'-disubstituted-1,7,8,13-perylene tetracarboxylic diimides, carboxybenzyl naphthaquinones, and combinations thereof; and wherein the polymeric binder material is selected from the group consisting of poly(vinyl chloride-co-vinyl acetate-co-2-hydroxypropyl acrylate-co-maleic acid); a terpolymer of polyvinyl chloride, polyvinyl acetate, and polyhydroxypropyl acrylate; a terpolymer of polyvinyl butyral, polyvinyl alcohol, and polyvinyl acetate; polyvinyl alcohol and its copolymers with cyanoethyl polyvinyl alcohol, and combinations thereof.

2. The imaging member according to claim 1, wherein said charge generating layer has a pigment to binder ratio of from about 70:30 to about 30:70 on a weight percent basis.

3. The imaging member according to claim 1, wherein said binder of said charge generating layer comprises 100% of the ETM-modified binder material.

4. The imaging member according to claim 1, wherein said binder further comprises an unmodified polymeric binder material.

5. The imaging member according to claim 4, wherein said binder has a ratio of ETM-modified binder to unmodified binder of from about 99:1 to about 1:99, on a weight percent basis.

6. The imaging member according to claim 1, wherein said electron transport material is grafted to said polymeric binder material.

7. An imaging member in accordance with claim 1, wherein the charge transport layer comprises aryl amines, and which aryl amines are of the formula

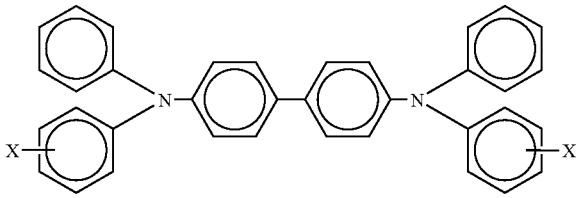

wherein X is selected from the group consisting of alkyl and halogen.

8. An imaging member in accordance with claim 7, wherein alkyl contains from about 1 to about 10 carbon atoms, or wherein alkyl contains from about 1 to about 5 carbon atoms, or optionally wherein alkyl is methyl, wherein halogen is chloride, and wherein there is further included a resinous binder selected from the group consisting of polycarbonates and polystyrenes.

9. An imaging member in accordance with claim 7, wherein the aryl amine is N,N'-diphenyl-N,N-bis(3-methyl phenyl)-1,1'-biphenyl-4,4'-diamine.

10. An imaging member comprising a substrate;

an optional hole blocking layer;

a charge generating layer; and a charge transport layer, wherein the charge generating layer comprises a photogenerating pigment and a binder, the binder comprising an ETM-modified binder, the ETM-modified binder comprising an electron transport material chemically attached to a polymeric binder material;

wherein the polymeric binder material is selected from the group consisting of poly(vinyl chloride-co-vinyl acetate-co-2-hydroxypropyl acrylate-co-maleic acid); a terpolymer of vinyl chloride, vinyl acetate, and hydroxypropyl acrylate; a terpolymer of vinyl butyral, vinyl alcohol, and vinyl acetate; a copolymer of vinyl alcohol and cyanoethyl vinyl alcohol; a polymer of the formula:

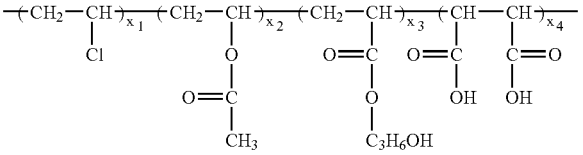

wherein $x_1$, $x_2$, $x_3$ and $x_4$ represent the molar percentage of each component in the polymer, and the sum of $x_1$, $x_2$, $x_3$ and $x_4$ is equal to 1; and combinations thereof; and wherein the electron transport material has a carboxylic acid or ester functional group.

11. The imaging member according to claim 10, wherein said electron transport material is selected from the group consisting of carboxy fluorenone malonitrile and derivatives thereof, a nitrated fluorenone, N,N'-disubstituted-1,4,5,8-naphthalene tetracarboxylic diimides, N,N'-disubstituted-1,7,8,13-perylene tetracarboxylic diimides, carboxybenzyl naphthaquinones, and combinations thereof.

12. The imaging member according to claim 10, wherein said electron transport material is grafted to from 1 to all of the available OH groups of said polymeric binder material.

13. The imaging member according to claim 10, wherein said charge generating layer has a photogenerating pigment to binder ratio of from about 95:5 to about 5:95.

14. A photoconductive imaging member in accordance with claim 10 wherein said polymeric binder material is selected from the group consisting of poly(vinyl chloride-co-vinyl acetate-co-2-hydroxypropyl acrylate-co-maleic acid); a terpolymer of polyvinyl chloride, polyvinyl acetate, and polyhydroxypropyl acrylate; a terpolymer of polyvinyl butyral, polyvinyl alcohol, and polyvinyl acetate; and combinations thereof.

15. The imaging member according to claim 10, wherein said polymeric binder material is selected from the group consisting of polymers of the formulae:

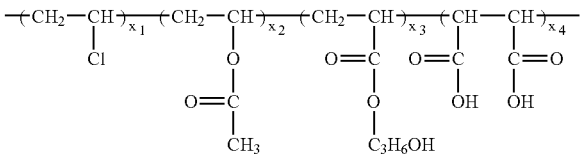

wherein $x_1$, $x_2$, $x_3$ and $x_4$ represent the molar percentage of each component in the polymer, and the sum of $x_1$, $x_2$, $x_3$ and $x_4$ is equal to 1;

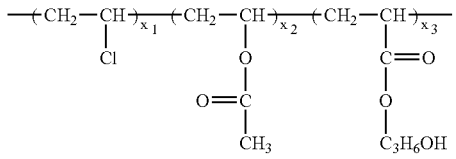

wherein $x_1$, $x_2$, and $x_3$ represent the molar percentage of each component in the polymer, and the sum of $x_1$, $x_2$, and $x_3$ is equal to 1; and

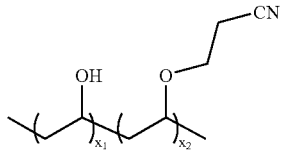

wherein $x_1$ and $x_2$ represent the molar percentage of each component in the polymer and the sum of $x_1$ and $x_2$ is equal to 1; and combinations thereof.

16. The imaging member according to claim 10, wherein said binder further comprises an unmodified polymeric binder material and has a ratio of ETM-modified binder to unmodified polymeric binder material of from about 99:1 to about 1:99 on a weight percent basis.

17. A method of imaging which comprises generating an electrostatic latent image on the imaging member of claim 10, developing the latent image, and transferring the developed electrostatic image to a suitable substrate.

* * * * *